US005077848A

United States Patent [19]

McDaniel et al.

[11] Patent Number: 5,077,848

[45] Date of Patent: Jan. 7, 1992

[54] WAVE DAMPENED WATERMATTRESS WITH TUBES AND LUMBAR SUPPORT

[76] Inventors: James E. McDaniel, 4149 Ellen Dr., Covina, Calif. 91722; Arturo Lucio, 15513 Gard Ave., Norwalk, Calif. 90650

[21] Appl. No.: 735,879

[22] Filed: Jul. 25, 1991

[51] Int. Cl.[5] ..... A47C 27/10

[52] U.S. Cl. ..... 5/451; 5/450

[58] Field of Search ..... 5/451, 450, 449, 455, 5/481, 422

[56] References Cited

U.S. PATENT DOCUMENTS 4,221,013 9/1980 Echevarria ..... 5/451

4,901,386 2/1990 Lane ..... 5/450

4,905,331 3/1990 Hochschild, III ..... 5/450

4,912,789 4/1990 Maxwell ..... 5/451

*Primary Examiner*—Alexander Grosz

*Attorney, Agent, or Firm*—Klein & Szekeres

[57] ABSTRACT

A tube-type watermattress has a plurality of elongated tubes disposed in a head-to-toe direction in the mattress. A wave dampening insert enclosed in each tube has a center portion which is substantially thicker than the rest of the insert to provide additional firmness and "lumbar" support in the area of the mattress where the lower back or "lumbar" of a person resting on the mattress is usually disposed.

22 Claims, 2 Drawing Sheets

WAVE DAMPENED WATERMATTRESS WITH TUBES AND LUMBAR SUPPORT

BACKGROUND OF THE INVENTION

1. Field of the Invention

The present invention is in the field of wave-dampened watermattresses. More particularly, the present invention is directed to a watermattress wherein the sleeping surface comprises a number of elongated tubes which have wave-dampening and lumbar supporting inserts.

2. Brief Description of the Prior Art

Water mattresses have been known in the prior art for a long time various devices and means have been used in the prior art to dampen the wave action in watermattresses. For example U.S. Pat. No 4,301,560 describes the use of lofted polyester fiber as a wave dampening insert in a watermattress. U.S. Pat. No 4,411,033 describes the use of buoyant floating polyurethane foam inserts as a wave-dampener in a watermattress U.S. Pat. No. 4,577,356 and other patent references cited in this patent, describe the use of wave-dampening baffles in watermattresses.

U.S. Pat. No. 4,221,013 describes the use of elongated water-filled tubes in a watermattress having a soft-sided (foam) frame of specific construction When the water-filled tubes are disposed "head-to-toe" in the watermattress they substantially prevent propagation of wave motion in a side-to-side direction. Inserts (such as foam or fiber) have also been used in the prior art within the elongated tubes to dampen the propagation of wave motion in the longitudinal direction.

Many persons find it desirable to have extra support or firmness disposed below their lower back and hip area when sleeping or resting on a watermattress. Although some, watermattresses of the prior art, such as U.S. Pat. No. 4,901,386 provide some extra firmness and "lumbar support" in the mid-section of the mattress, such lumbar support has not been available in tube-type watermattresses of the prior art.

The present invention accomplishes wave dampening in a tube-type watermattress and provides extra support or firmness in the area where most persons desire lumbar support.

SUMMARY OF THE INVENTION

It is an object of the present invention to provide a watermattress which is wave-dampened and provides extra lumbar support to a person resting or sleeping on the watermattress.

It is another object of the present invention to provide a watermattress which provides the advantages of a tube-type watermattress and still provides extra lumbar support to a person resting or sleeping on the watermattress.

The foregoing and other objects and advantages are attained by a watermattress, which includes a plurality of elongated water-filled tubes in a suitable frame. The elongated tubes are disposed "head-to-toe" in the watermattress, and include a wavedampening insert which is foam or fiber (preferably foam) of substantially less height than the height of the water-filled tube. Substantially in the mid-section of the tube, in the area where lumbar support is needed for person resting on the tube-type watermattress, the wave-dampening insert is substantially higher, thicker or firmer than in other section of the tube, so that the insert in the mid-section provides extra support.

The features of the present invention can be best understood together with further objects and advantages by reference to the following description, taken in connection with the accompanying wherein like numerals indicate like parts.

DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventors for carrying out their invention, although it should be understood that various modifications can be accomplished within the parameters of the present invention.

Figure 3:
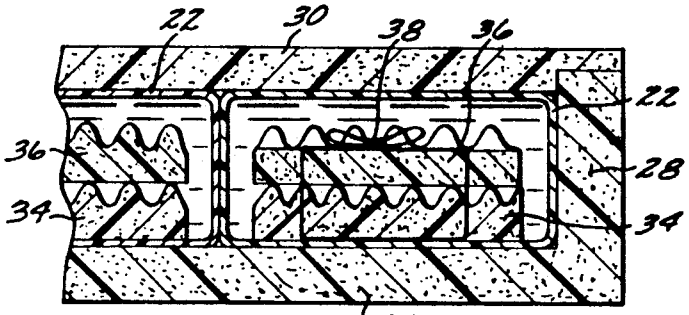
FIG. 3 is a cross-sectional view taken on lines 3,3 of FIG. 2.
Figure 1:
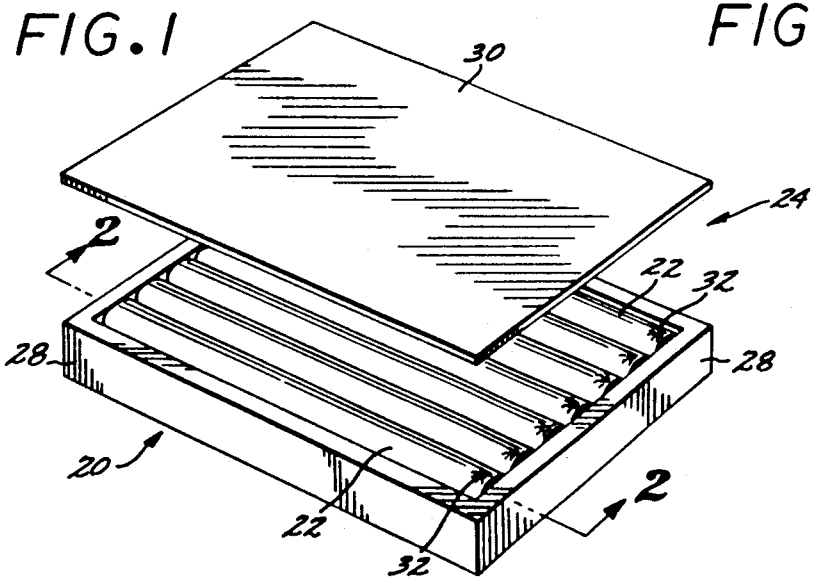
FIG. 1 is a perspective view of a first preferred embodiment of a watermattress constructed in accordance with the present invention.
Figure 2:
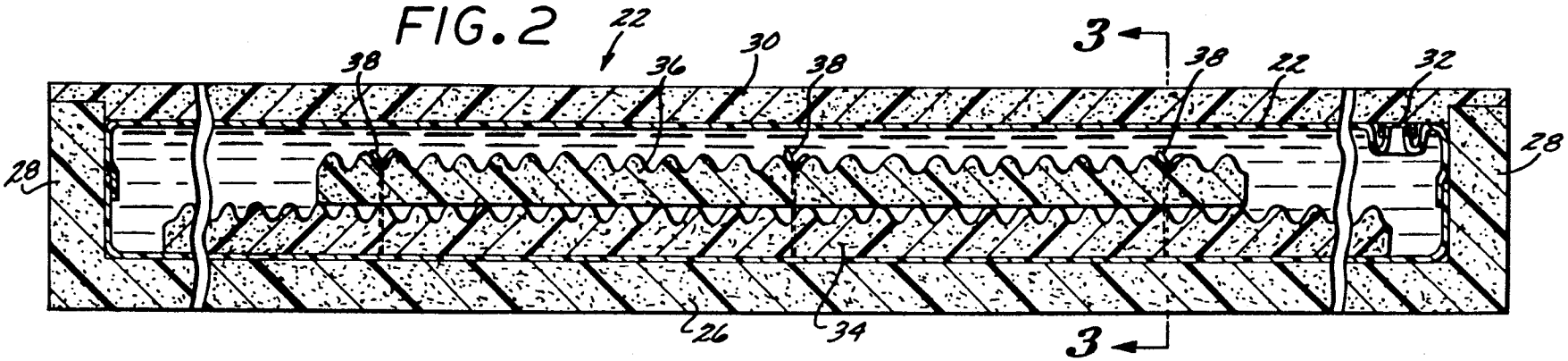
FIG. 2 is a cross-sectional view taken on lines 2,2 of FIG. 1.

Referring now to FIGS. 1-3 of the appended drawings, a first preferred embodiment 20 of the watermattress of the present invention is disclosed. The watermattress of the present invention utilizes a plurality of elongated water containers or tubes 22 to provide a "flotation type" sleeping surface. The elongated water containers or tubes 22 are disposed "head-to-toe" in the watermattress, which includes a soft-sided frame 24 made of foam. The frame 24 forms a cavity into which the tubes 22 are placed. The frame 24 or cavity includes a bottom panel 26, side panels 28 which form vertical walls, and a top panel 30. inasmuch as the basic concept of a soft-sided tube-type watermattress is generally known in the art, and inasmuch as a specific construction of a tube-type soft-sided watermattress is described in U.S. Pat. No. 4,221,013, a more detailed description of the tube-type watermattress is not considered necessary. The specification of U.S. Pat. No. 4,221,013 is expressly incorporated herein by reference. Quilting and fabric which conventionally covers the watermattress are not shown in the appended drawings. Each tube has a capped valve 32 to permit filling the tube 22 with water.

As it will be readily apparent from the ensuing description, the principal novel feature of the present invention is in the nature and configuration of the inserts which are placed into the individual tubes 22 of the watermattress. Therefore, it should be understood that the present invention is not limited by the particular nature or configuration of the "soft-sided" frame 24 into which the tubes 22 are placed, and that the water containers or tubes 22 having the lumbar supporting inserts of the invention could be utilized even in a hard-sided watermattress (not shown) which employs a plurality of tubes as a sleeping surface.

As is well known in the watermattress industry, the tubes 22 of a tube-type watermattress which are placed head-to-toe substantially prevent transmittal of wave motion from side to side, and offer certain other advantages as well. For example, it is generally considered easier to assemble or disassemble, fill or drain a tube-type watermattress than a single-bladder watermattress of similar size, and leakage of a single tube of a tube-type mattress is generally considered to be less troublesome than leakage from a single bladder watermattress.

Generally speaking, approximately 6 to 9 tubes 22 are used in a watermattress, the exact number depending on the size of the mattress and on the width of the tubes 22 Referring to FIGS. 2 and 3 of the appended drawings, in accordance with the present invention a first elongated insert 34 is placed into each tube 22. The first insert 34 is preferably a piece of open cell foam of substantially rectangular cross-section, but it can also be lofted fiber, substantially of the type which is described in U.S. Pat. No. 4,301,560. Most preferably, the first insert 34 is an elongated piece of open cell foam which on one side has egg-crate like configuration; this type of foam is also known in the art as convoluted foam and can be made in accordance with the state of the art by cutting a block of foam in a state-of-the-art, commercially available "convoluting" machine.

In accordance with the present invention, the first elongated insert 34 is substantially as long as the tube 22, meaning that the first insert 34 is designed to provide wavereduction in substantially the entire length of the tube 22. For this reason the first insert 34 of the preferred embodiments is at least approximately as long as 90% of the length of the tube 22. The first insert 34 is also substantially lower than the height of the water-filled tube 22, usually less than approximately 50% of the height of the tube 22.

In accordance with the present invention a second insert 36 is attached to the first insert 34. The second insert 36 is located in the tube in such a manner that it is disposed primarily below the lower back and hip area of a person (not shown) who may be resting on the watermattress. To this end, the second insert 36 is substantially shorter than the first insert 34 and is centrally located above the first insert 34 so that the mid-points of both inserts 34 and 36 are substantially superimposed. The combined height of the first and second inserts 34 and 36 is such that the two inserts 34 and 36 together make up a substantial portion of the total height of the water filled tube. The second insert 36 , like the first insert 34, is preferably made from foam, most preferably convoluted foam, as is shown on FIGS. 3 and 4, although it can also be made of fiber. The principal function of the combined inserts are to provide an enhanced lengthwise wave dampening effect and to provide in the lower back or lumbar area of the mattress extra firmness as "lumbar" support to a user.

With reference to standard mattress sizes established in the industry, the following actual exemplary dimensions for the first preferred embodiment of the tubes 22 and the inserts 34 and 36 are described.

The tubes are approximately 9 inches wide and approximately 4 inches high. The inserts are 6 inches wide and each insert is 1.5 inch high. Thus, the combined inserts in the lumbar area are approximately 3 inches high, approximately 75% of the total height of the tube 22.

"California King" : length of tube 78 inches; length of first insert 72 inches; length of second insert 36 inches. "Queen" and "Eastern King"length of tube 74 inches; length of first insert 70 inches; length of second insert 36 inches. "Twin" and "Full": length of tube 68 inches; length of first insert 64 inches; length of second insert 30 inches.

Figure 4:
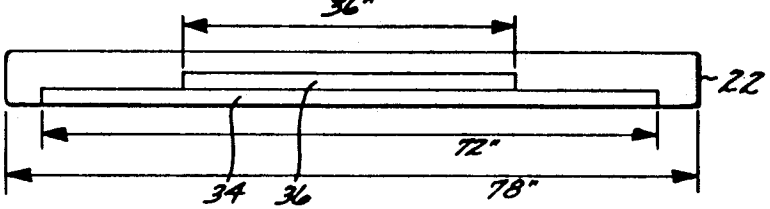
FIG. 4 is a diagrammatic view showing dimensions of a tube and wave-dampening and lumbar supporting insert in the first preferred embodiment.

FIG. 4 of the appended drawings illustrates the foregoing dimensions for the tubes 22 of a "California King" size watermattress.

As is shown in FIGS. 2 and 3, the first and second inserts 34 and 36 of the first preferred embodiment are attached to one another with several ties or straps 38, although it should be understood that other mechanical means of attachment are also possible. The foam utilized for the inserts 34 and 36 of the first preferred embodiment 20 has an indentation load deflection (ILD) of at least 33 (or larger) and a density factor of at least 1 pound (or larger).

Figures 5, 6, 7, 8, 9, 10, 11:
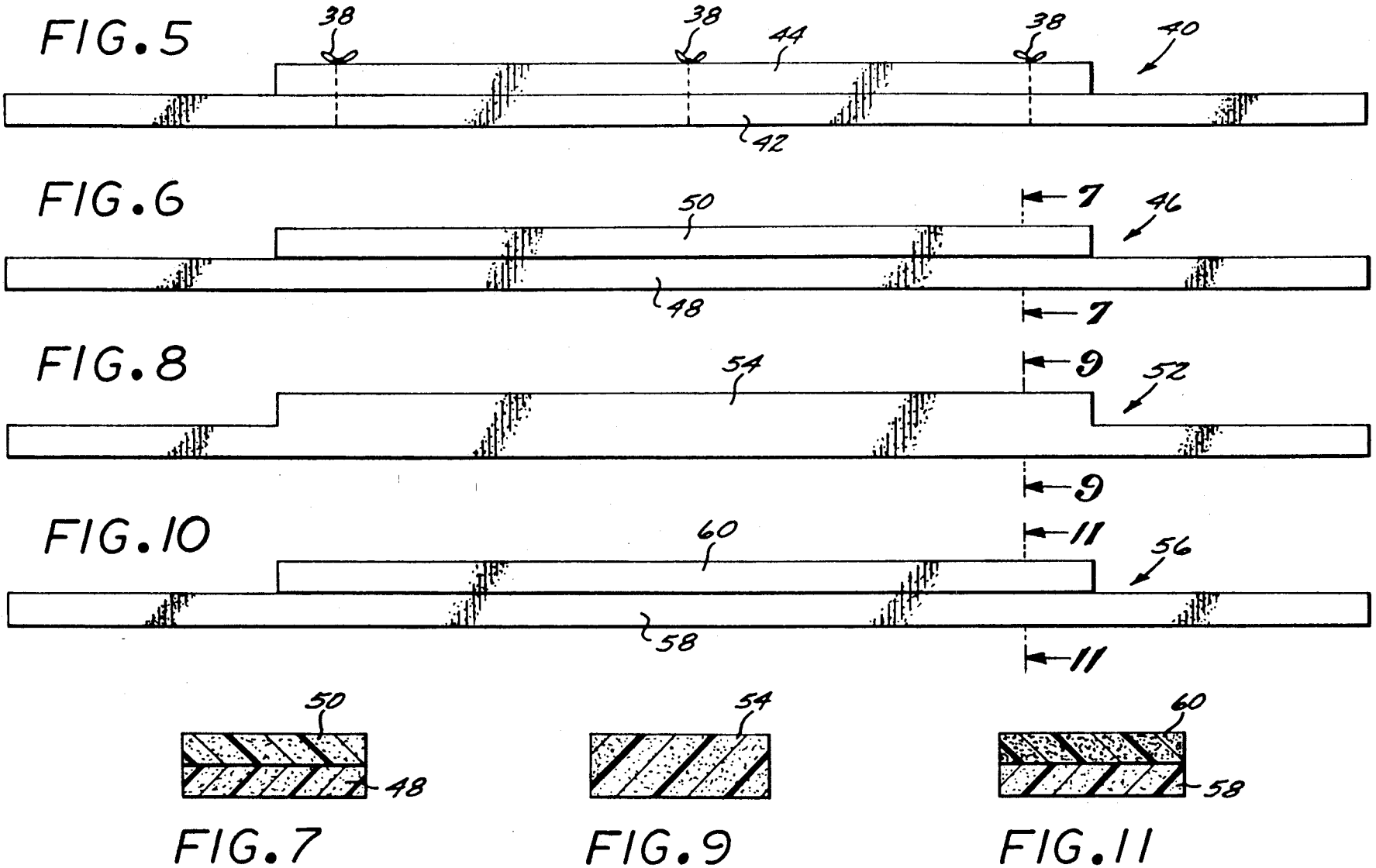
FIG. 5 is a side view of the insert of a second preferred embodiment of the invention.
FIG. 6 is a side view of the insert of a third preferred embodiment of the invention.
FIG. 7 is a cross-sectional view taken on lines 7,7 of FIG. 6.
FIG. 8 is a side view of the insert of a fourth preferred embodiment of the invention.
FIG. 9 is a cross-sectional view taken on lines 9,9 of FIG. 8.
FIG. 10 is a side view of the insert of a fifth preferred embodiment of the invention.
FIG. 11 is a cross-sectional view taken on lines 10,10 of FIG. 10.

Referring now to FIG. 5 of the appended drawings, the wave-dampening and lumbar supporting inserts of a second preferred embodiment 40 are shown. The inserts 42 and 44 of the second preferred embodiment 40 are similar in construction to the inserts of the first preferred embodiment 20, the primary difference being that in the second preferred embodiment the foam inserts are not convoluted.

FIGS. 6 and 7 disclose the wave-dampening and lumbar supporting inserts of a third preferred embodiment 46. In this embodiment the first insert 48 and second insert 50 both comprise plain (non-convoluted) foam and the two inserts 48 and 50 are glued to one another.

FIGS. 8 and 9 disclose the wave-dampening and lumbar supporting insert of a fourth preferred embodiment 52. In this embodiment 52 the entire is insert 54 is formed from a single block of foam into the configuration shown, which corresponds substantially to the above-described configuration of the combined inserts of the first preferred embodiment 20.

FIGS. 10 and 11 disclose the inserts of a fifth preferred embodiment 56 where the first insert 58 and the second insert 60 are comprised of foam of different ILD and density factor.

As it will be readily appreciated by those skilled in the art, the principal advantage of the present invention is providing lumbar support in a tube-type watermattress. An additional advantage of the tube-type watermattresses of the present invention is that in accordance with the user's preference, some of the tubes of a mattress may contain the lumbar supporting insert, while the other tubes (for example tubes on the edges) may not have such insert. Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. A water container to be used in a waterbed mattress, comprising:

an elongated tube, having pliant but substantially non-stretchable walls and valve means for filling the tube with water and for capping the water-filled tube, the tube having first and second ends to be disposed, respectively, towards the head and foot of the watermattress, a wave dampening filler contained within the tube disposed substantially along its entire length, the wave dampening filler being substantially thicker in the center portion of the tube than in sections proximate to the respective head and foot ends of the tube, whereby the center portion of the tube is firmer and provides more support to a human body lying on the watermattress than the sections proximate to the respective head and foot ends of the tube.

2. The water container of claim 1 wherein the wave dampening filler comprises open cell foam.

3. The water container of claim 1 wherein the wave dampening filler comprises lofted fiber material.

4. The water container of claim 1 wherein the wave dampening filler comprises a first and a second piece of foam material, the first piece of foam being disposed within the tube substantially along its entire length and being of substantially lesser height than the height of the tube substantially filled with water, the second piece of foam being attached to the first piece of foam and being substantially shorter than the first piece, the combined height of the first and second pieces being at least approximately 60% of the height of the tube filled with water.

5. The water container of claim 4 wherein the first and second pieces of foam are mechanically attached to one another.

6. The water container of claim 5 where the first and second pieces of foam each have an egg-crate like configuration on one side thereof.

7. The water container of claim 5 where the first and second pieces of foam comprise open cell foam having an indentation load deflection value of at least 33, and a density factor of at least 1 pound.

8. A lumbar-supporting wave-dampened tube to be used in a waterbed mattress of the type containing a plurality of elongated water-filled tubes to provide a sleeping surface, the tube comprising:

a pliant and substantially non-stretchable material forming the walls of said tube, the tube being of elongated shape and substantially the length of the sleeping surface provided by the waterbed mattress where the tube is used;

valve means attached to the walls for permitting filling the tube with water and for capping the same;

a first elongated wave-dampening insert disposed in the tube substantially along the length of the tube, the first insert being of substantially lesser height than the height of the tube when the tube is substantially filled with water, and a second elongated wave-dampening insert disposed in the tube substantially in the center portion thereof attached to and above the first wave-dampening insert, the combined height of the first and second inserts being a substantial portion of the height of the tube when the tube is substantially filled with water, whereby the center portion of the tube provides a firmer sleeping surface than the end portions of the tube, and whereby the center portion of the tube provides lumbar support to a person resting on the waterbed mattress comprising said tube.

9. The wave dampened tube of claim 8 wherein the first and second inserts comprise lofted fiber.

10. The wave-dampened tube of claim 8 wherein the first and second inserts each comprise open cell foam.

11. The wave dampened tube of claim 10 wherein the first and second inserts each Comprise open cell foam which has an egg-crate-like configuration including projections and valleys on at least one major surface thereof.

12. The wave dampened tube of claim 10 wherein the first and second inserts are attached to one another with at least one tie 13. The wave dampened tube of claim 10 wherein the length of the second insert is approximately one half the length of the first insert.

14. The wave dampened tube of claim 10 wherein the height of the first insert is approximately the same as the height of the second insert.

15. The wave dampened tube of claim 14 wherein the height each insert is approximately 1½ inch.

16. A waterbed mattress comprising a soft-sided frame and a plurality of water-filled elongated tubes which are adjacent to one another and jointly provide a sleeping surface, each of the tubes having pliant but substantially non-stretchable walls and valve means for filling the tube with water and for capping the water-filled tube, each tube having first and second ends to be disposed, respectively, towards the head and foot of the watermattress, and a wave dampening filler contained within the tube disposed substantially along its entire length, the wave dampening filler being substantially thicker in the center portion of the tube than in sections proximate to the respective head and foot ends of the tube, whereby the center portion of the tube is firmer and provides more support to a human body lying on the watermattress than the sections proximate to the respective head and foot ends of the tube.

17. The waterbed mattress of claim 16 wherein the wave dampening filler of each tube comprises open cell foam.

18. The waterbed mattress of claim 16 wherein the wave dampening filler comprises lofted fiber material.

19. The waterbed mattress of claim 16 wherein the wave dampening filler comprises a first and a second piece of foam material, the first piece of foam being disposed within the tube substantially along its entire length and being of substantially lesser height than the height of the tube substantially filled with water, the second piece of foam being attached to the first piece of foam and being substantially shorter than the first piece, the combined height of the first and second pieces being at least approximately 60 % of the height of the tube filled with water.

20. The waterbed mattress of claim 16 wherein the first and second pieces of foam are mechanically attached to one another.

21. The water container of claim 16 where the first and second pieces of foam each have an egg-crate like configuration on one side thereof.

22. The water container of claim 21 where the first and second pieces of foam comprise open cell foam having an indentation load deflection value of at least 33, and a density factor of at least 1 pound.

* * * * *